US007789242B2

(12) United States Patent
Shuai et al.

(10) Patent No.: US 7,789,242 B2
(45) Date of Patent: Sep. 7, 2010

(54) PROTECTIVE PACKAGING FOR AN LED MODULE

(75) Inventors: Chun-Jiang Shuai, Shenzhen (CN); Guang Yu, Shenzhen (CN); Cheng-Tien Lai, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 120 days.

(21) Appl. No.: 12/200,872

(22) Filed: Aug. 28, 2008

(65) Prior Publication Data

US 2009/0236262 A1 Sep. 24, 2009

(30) Foreign Application Priority Data

Mar. 21, 2008 (CN) ..... 2008 1 0066154

(51) Int. Cl.
*B65D 85/00* (2006.01)

(52) U.S. Cl. ..... 206/719; 206/723; 220/345.1

(58) Field of Classification Search ..... 220/505, 220/345.1, 345.2; 206/701, 706, 709, 713, 206/714, 719, 722, 723
See application file for complete search history.

(56) References Cited

U.S. PATENT DOCUMENTS

| | | | | |
|---|---|---|---|---|
| 2,562,248 | A * | 7/1951 | Weed | 220/345.1 |
| 2,992,726 | A * | 7/1961 | Simens | 206/525 |
| 3,527,373 | A * | 9/1970 | Giraudet et al. | 220/345.1 |
| 5,667,063 | A * | 9/1997 | Abe | 206/204 |
| 2006/0157382 | A1 * | 7/2006 | Yasufuku et al. | 206/714 |
| 2008/0041734 | A1 * | 2/2008 | Bergelson | 206/6.1 |
| 2009/0021937 | A1 * | 1/2009 | Sloan et al. | 362/249 |

* cited by examiner

*Primary Examiner*—Jacob K Ackun, Jr.
(74) *Attorney, Agent, or Firm*—Frank R. Niranjan

(57) ABSTRACT

A protective packaging for protecting an LED module from being damaged during transportation, includes a housing containing the LED module therein and a cover slidably fixed in the housing to cover a top opening of the housing. The housing defines a room to receive the LED module therein. A bottom portion of the housing is concaved to form a space, in which a thermal interface material bonded on the LED module is accommodated. An end of the housing is closed to abut against an end of the cover, and an opposite end of the housing is partially opened to receive an opposite end of the cover. The protective packaging is made from an antistatic plastic and has a wall thickness larger than 0.5 mm.

17 Claims, 4 Drawing Sheets

PROTECTIVE PACKAGING FOR AN LED MODULE

BACKGROUND OF THE INVENTION

1. Field of the Invention

The present invention relates to a protective packaging, and more particularly to a protective packaging with thick walls to securely protect an LED module received therein, wherein the LED module has a thermal interface material attached to a bottom thereof.

2. Description of Related Art

LEDs have been available since the early 1960's. Because of the relatively high light-emitting efficiency of LEDs, nowadays LED usage has been increased in popularity in a variety of applications, e. g., residential, traffic, commercial, industrial settings. For achieving a convenient control for many LEDs, the LEDs are often mechanically arranged and electrically connected on a common printed circuit board to thereby form an LED module. Lots of LED modules are then assembled into a lamp enclosure to construct an LED lamp.

After being manufactured in one place, sometimes the LED modules are required to be packaged first, and then transported to another place to be assembled together to form various LED lamps. A conventional packing method is to use a plastic bag to receive an LED module therein. Then an opening end of the plastic bag is sealed. The plastic bags with the LED modules therein are stacked in a box to thereby be transported to the another place.

The plastic bag can protect the LED module from contamination or being wetted during the transportation. However, since a bag wall of the plastic bag is relatively thin (commonly less than 0.03 mm) and easy to deform, the plastic bag is unable to provide the LED module with a sufficient protection when subject to a relatively large force acting thereon. During the transportation, the LED modules in the plastics bags may collide with each other, and accordingly the LED modules may be damaged due to the collision. Even worse, such collision may directly act on the LEDs of the LED module and cause them to be broken. In addition, if the LED module is attached with a thermal interface material beforehand, it is not suitable to use the plastic bag as the packing material since the plastic bag will contact and contaminate the thermal interface material.

What is needed, therefore, is a protective packaging which can overcome the above-mentioned disadvantages.

SUMMARY OF THE INVENTION

A protective packaging for protecting an LED module from being damaged during transportation, includes a housing containing the LED module therein and a cover slidably fixed in the housing to cover a top opening of the housing. The housing defines a room to receive the LED module therein. A bottom portion of the housing is concaved to form a space below the room. The space is narrower than the room. A thermal interface material, for example, thermal grease or thermal tape, bonded on the LED module is accommodated in the space. An end of the housing is closed to abut against an end of the cover, and an opposite end of the housing is partially opened to receive an opposite end of the cover. The protective packaging is made from an antistatic plastic and has a wall thickness larger than 0.5 mm. For such a large wall thickness, the protective packaging can significantly resist most of impact when the LED module is subject to shock or vibration, and accordingly protect the LED module from being damaged unexpectedly. Furthermore, the antistatic material of the protective packaging can effectively prevent static electricity from accumulating on the LED module due to friction occurring between the LED module and the protective packaging during transportation; thus, electrostatic shock to the LED module can be avoided.

Other advantages and novel features of the present invention will become more apparent from the following detailed description when taken in conjunction with the accompanying drawings.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
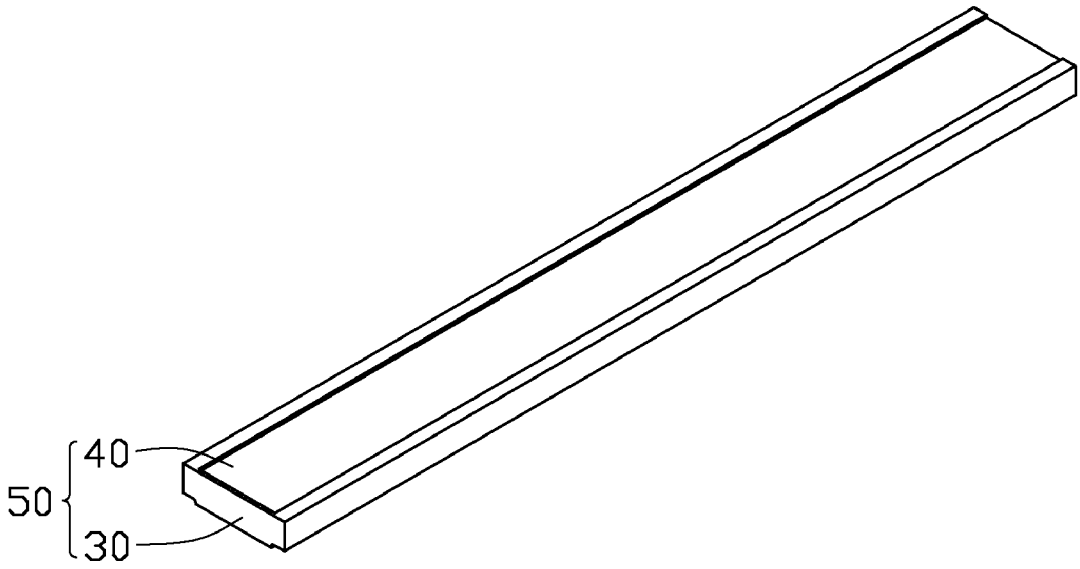
FIG. 1 is an assembled, perspective view of a protective packaging in accordance with a preferred embodiment of the present invention, with an LED module contained therein.
Figure 3:
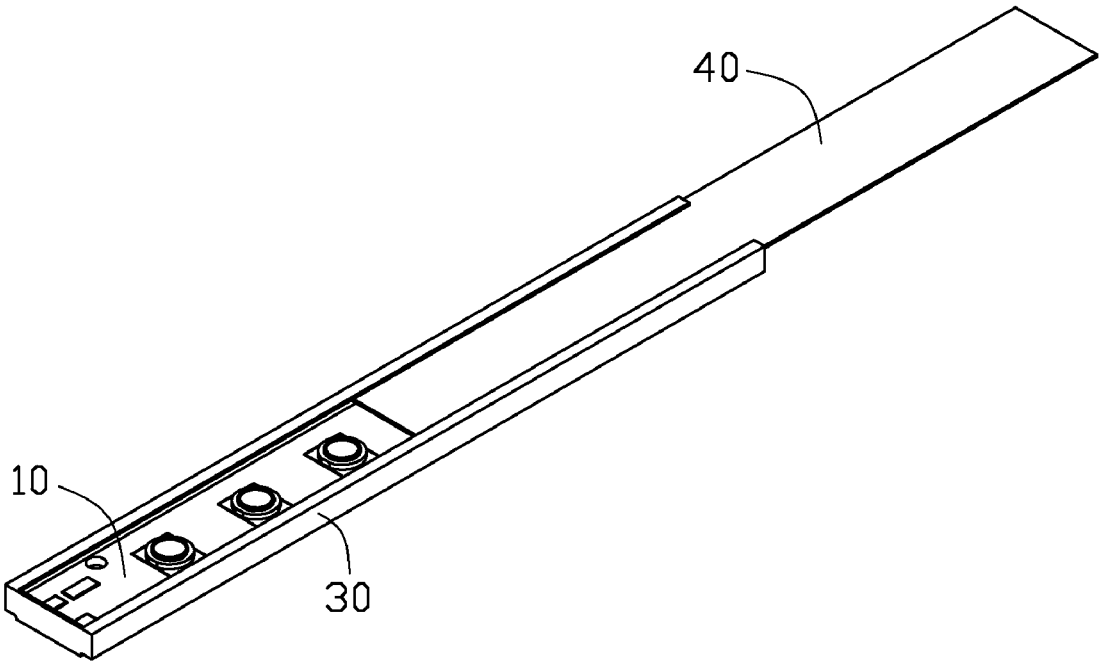
FIG. 3 is a view similar to FIG. 1, showing a cover of the protective packaging moved to a partially opened position.

Referring to FIGS. 1 and 3, a protective packaging 50 in accordance with a preferred embodiment of the present invention is used to protect an LED module 10 received therein. The protective packaging 50 comprises a rectangular housing 30 holding the LED module 10 and a thermal interface material 20 therein, and a rectangular cover 40 movably attached in the housing 30 and located above the LED module 10 and the thermal interface material 20. The thermal interface material 20 can be thermal tape or thermal grease attached to a bottom of the LED module 10. The protective packaging 50 is made of plastic with a degree of rigidness. Preferably, a wall thickness of the protective packaging 50 of the present invention is selected to be larger than 0.5 mm, to thereby provide the protective packaging 50 with a sufficient strength so that the protective packaging 50 can keep its original shape even when subject to a large external force acting thereon. Moreover, with such a large wall thickness compared with that of the conventional plastic bag, the protective packaging 50 can withstand a relatively large shock and remain its original configuration easily; in other words, the protective packaging 50 is capable of resist most of external impact acting thereon and protecting the LED module 10 received therein from colliding with other LED modules 10 during transportation of the LED modules 10.

Figure 2:
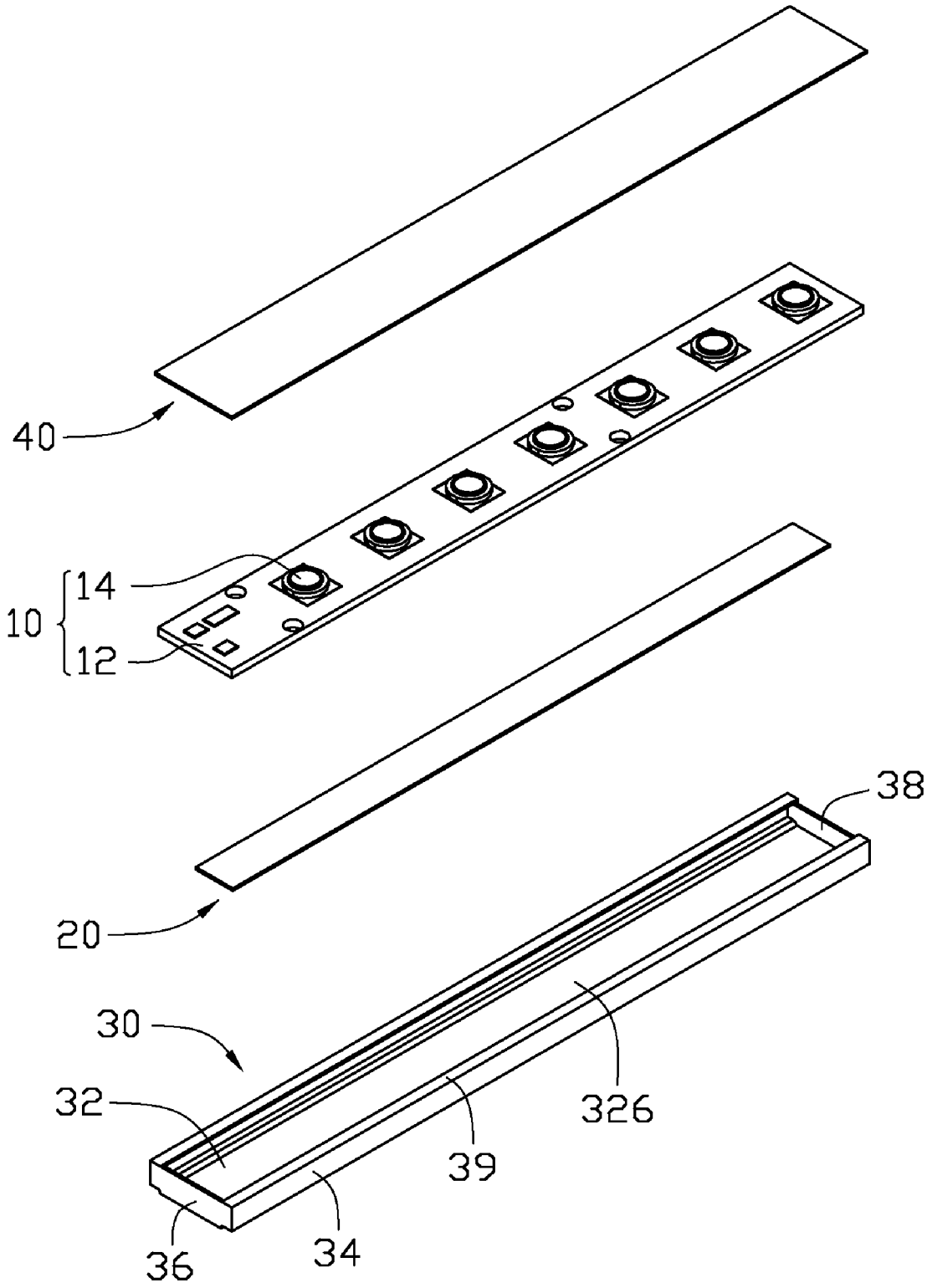
FIG. 2 is an exploded view of FIG. 1.
Figure 4:
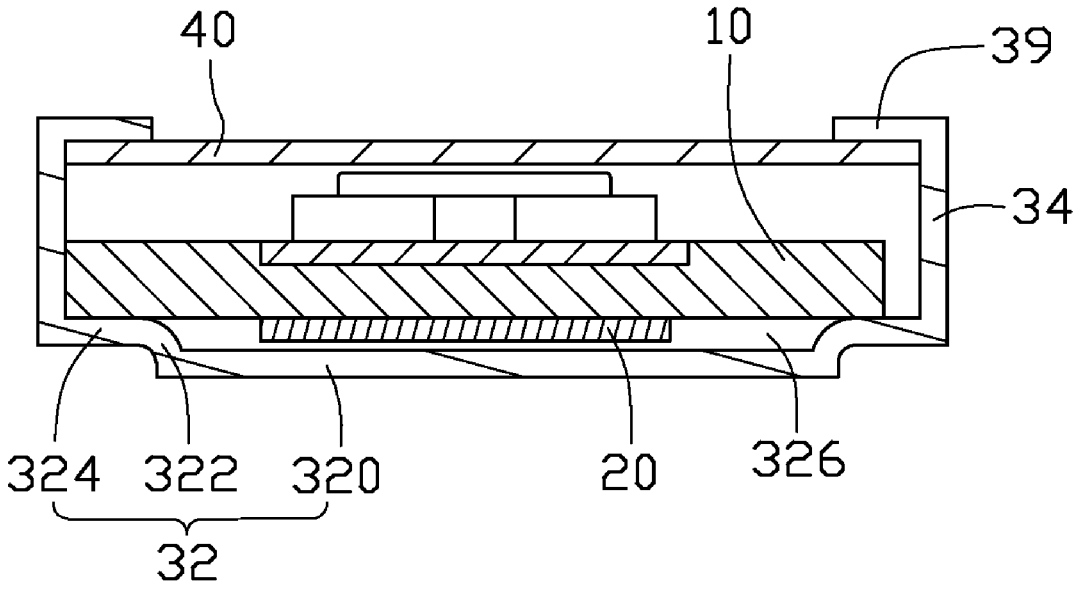
FIG. 4 is a cross-sectional view of FIG. 1.

Particularly referring to FIG. 2, the housing 30 comprises a bottom plate 32, a pair of sidewalls 34 extending upwardly from two opposite sides of the bottom plate 32, a pair of baffle plates 36, 38 extending upwardly from another two opposite sides of the bottom plate 32, and a pair of flanges 39 projecting inwardly from two tops of the pair of sidewalls 34 (also referring to FIG. 4), respectively. The bottom plate 32 comprises a rectangular panel 320, a pair of arced steps 322 extending outwardly and upwardly from two opposite sides of the panel 320, and a pair of strips 324 formed horizontally and outwardly from two extremities of the pair of steps 322, respectively. The panel 320, the pair of steps 322, and lower portions of the pair of baffle plates 36, 38 cooperatively enclose a space 326. The space 326 is particularly devised to receive the thermal interface material 20 on the LED module 10 therein, to ensure that the thermal interface material 20 would not be contaminated during the transportation. The space 326 is nearly rectangular in shape, wherein two opposing, inner surfaces of the pair of steps 322 defining two facing laterals of the space 326 are curved, two opposing, inner surfaces of the pair of baffle plates 36, 38 defining another two facing laterals of the space 326, and a top surface of the panel 320 defining a bottom of the space 326 are flat.

The sidewalls 34 are located perpendicular to and between the flanges 39 and the strips 324. The strips 324 are oriented parallel to the flanges 39. The flanges 39 are located coplanar to each other; each flange 39 have a width similar to that of each strip 324, for confining the cover 40 to the housing 30 when the cover 40 is fittingly and slidably inserted into the housing 30. The sidewalls 34, the baffle plates 36, 38, and the bottom plate 32 cooperatively defining a room (not labeled) which includes the space 326 in a lower portion thereof. The space 326 is narrower than the room. A portion of the room located over the space 326 has a depth slightly larger a total thickness of the LED module 10 and the cover 40 combined together; thus, the LED module 10 and the cover 40 can be entirely retained into the room. A depth of the space 326 is about one-sixth of that of the room and larger than that of the thermal interface material 20, thereby substantially receiving the thermal interface material 20 therein.

Also shown in FIG. 3, the baffle plate 36 located at a front end of the housing 30 is connected to front parts of the pair of sidewalls 34 and the pair of flanges 39 to substantially seal the front end of the housing 30, while the baffle plate 38 is merely coupled to rear parts of the pair of sidewalls 34 and spaced from the pair of flanges 39 via a slit (not labeled) therebetween, thus partially sealing the rear end of the housing 30. The slit is used to receive the cover 40 sliding into the housing 30 along a lengthwise direction of the housing 30. The slit has a height slightly less than a thickness of the cover 40, whereby the cover 40 can interferingly engage with the baffle plate 38 and the flanges 39 of the housing 30 when the cover 40 is inserted into the slit. Accordingly, a risk that the cover 40 falls from the housing 30 unexpectedly during transportation is avoided.

The LED module 10 consists of a rectangular substrate such as a printed circuit board 12 and a plurality of LEDs 14 equidistantly arranged on a top face of the printed circuit board 12. The thermal interface material 20 is adhered on a central area of a bottom face of the printed circuit board 12. The thermal interface material 20 is used for thermally bonding the LED module 10 on a support (not shown), for example, a heat sink or a lamp shell of a lamp (not shown) when the LED module 10 is mounted to the lamp, whereby heat generated by the LEDs 14 can be dissipated by the lamp shell or heat sink via the thermal interface material 20.

Before being transported, the LED module 10 is accommodated into the housing 30 with the thermal interface material 20 received in the space 326 and lateral sides of the bottom face of the printed circuit board 12 abutting against top faces of the two strips 324. Then the cover 40 is slid into the slit from the rear end of the housing 30 to reach the front end of the housing 30 through a guide of the flanges 39. When the cover 40 abuts the baffle plate 36 at the front end of the housing 30, a whole package of the LED module 10 with the thermal interface material 20 into the protective packaging 50 is completed. Next, the protective packaging 50 is stacked in a large box (not shown) with other protective packaging 50 to be ready for transportation.

Since the wall of the protective packaging 50 has a relatively large thickness, compared with that of the plastic bag commonly utilized, the protective packaging 50 can sufficiently protect the LED module 10 contained therein from external force, and thus protecting the LED module 10 from being damage, even if the protective packaging 50 is subject to shock or vibration during the transportation.

Furthermore, in order to prevent static electricity from accumulating on the LED module 10, the material of the protective packaging 50 can be chosen from some antistatic materials, such as polyethylene terephthalate (PET).

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A protective packaging for protecting an LED module therein, comprising:

a housing for containing the LED module therein; and a cover movably attached in the housing to cover an opening of the housing, wherein the housing has a wall thickness of at least 0.5 mm;

wherein the housing comprises a bottom plate, a pair of sidewalls extending upwardly from two opposite sides of the bottom plate and a pair of baffle plates extending upwardly from another two opposite sides of the bottom plate, the bottom plate, the pair of sidewalls and the pair of baffle plates together defining a room adapted for receiving the LED module therein;

wherein the bottom plate has a portion concaved downwardly to form a space, the space being at a lower part of the room, the space being adapted for receiving a thermal interface material attached to the LED module;

wherein the housing further comprises a pair of flanges extending inwardly from tops of the pair of sidewalls, respectively, the cover being in interfering contact with the pair of flanges; and wherein one of the pair of baffle plates is connected to the pair of flanges to seal one end of the housing, an extremity of the cover abutting against the one of the pair of baffle plates.

2. The protective packaging as claimed in claim 1, wherein two opposite surfaces of the bottom plate defining two confronting laterals of the space are arced.

3. The protective packaging as claimed in claim 1, wherein another one of the pair of baffle plates is spaced from the pair of flanges via a slit to partially seal an opposite end of the housing, an opposite extremity of the cover being fittingly received in the slit.

4. The protective packaging as claimed in claim 1, wherein the pair of flanges are oriented perpendicular to the pair of sidewalls and parallel to the cover.

5. The protective packaging as claimed in claim 1, wherein the cover is slidably relative to the housing.

6. The protective packaging as claimed in claim 1, wherein the housing and the cover are made from an antistatic material.

7. An LED package comprising:

an LED module having a thermal interface material attached to a bottom thereof;

a protective packaging receiving the LED module therein, comprising:

a housing defining a room accommodating the LED module therein, the housing has a closed end and a partially opened end opposite to the closed end; and a cover retained in the housing to cover the LED module, the cover having an extremity abutting against the closed end of the housing, and an opposite extremity fitted in the partially opened end of the housing;

wherein the room having a narrowed lower space receiving the thermal interface material therein.

8. The LED package as claimed in claim 7, wherein the partially opened end of the housing defines a slit, the slit having a height less than a thickness of the cover to interferingly receive the opposite extremity of the cover therein.

9. The LED package as claimed in claim 7, wherein the cover is rectangular and planar and slidably received in a top of the housing.

10. The LED package as claimed in claim 7, wherein the housing has a pair of flanges extending toward each other above the room, the pair of flanges abutting against a top of the cover to confine the cover to the housing.

11. The LED package as claimed in claim 7, wherein the protective packaging is antistatic.

12. The LED package as claimed in claim 11, wherein the protective packaging is made from antistatic plastic.

13. The LED package as claimed in claim 7, wherein the protective packaging has a wall thickness larger than 0.5 mm.

14. An LED package comprising:

a housing defining a room having an upper portion and a lower portion narrower than the upper portion;

an LED module including a substrate, at least an LED mounted on a top of the substrate and a thermal interface material attached to a bottom of the substrate, wherein the at least LED and the substrate are received in the upper portion of the room and the thermal interface material is received in the lower portion of the room; and a cover attached to the housing to cover an upper opening of the room.

15. The LED package as claimed in claim 14, wherein the substrate is a printed circuit board.

16. The LED package as claimed in claim 14, wherein the thermal interface material is one of thermal grease and thermal tape.

17. The LED package as claimed in claim 14, wherein the cover is slidably attached to the housing.

* * * * *